US007343756B2

(12) United States Patent
Chang et al.

(10) Patent No.: US 7,343,756 B2
(45) Date of Patent: Mar. 18, 2008

(54) AIR CONDITIONING SYSTEM

(75) Inventors: Se-Dong Chang, Seoul (KR); Sai-Kee Oh, Seoul (KR); Chi-Woo Song, Seoul (KR); Baik-Young Chung, Seoul (KR); Ju-Won Kim, Seoul (KR); Bong-Soo Park, Seoul (KR)

(73) Assignee: LG Electronics Inc., Seoul (KR)

( * ) Notice: Subject to any disclaimer, the term of this patent is extended or adjusted under 35 U.S.C. 154(b) by 271 days.

(21) Appl. No.: 11/286,358

(22) Filed: Nov. 25, 2005

(65) Prior Publication Data

US 2006/0112713 A1 Jun. 1, 2006

(30) Foreign Application Priority Data

Nov. 26, 2004 (KR) ..... 10-2004-0098190

(51) Int. Cl.
*F25B 13/00* (2006.01)
*F25B 43/00* (2006.01)

(52) U.S. Cl. ..... 62/324.1; 62/512

(58) Field of Classification Search ..... 62/160, 62/161, 238.6, 434, 238.7, 512, 324.1, 324.6
See application file for complete search history.

(56) References Cited

U.S. PATENT DOCUMENTS 2,983,112 A * 5/1961 Batteiger ..... 62/156
4,327,560 A * 5/1982 Leon et al. ..... 62/260
4,335,580 A * 6/1982 Hannett et al. ..... 62/79
4,339,930 A * 7/1982 Kirts ..... 62/235.1
4,720,982 A * 1/1988 Shimizu et al. ..... 62/204
4,896,514 A * 1/1990 Sugiyama et al. ..... 62/404
5,235,820 A * 8/1993 Radermacher et al. ..... 62/114
5,632,442 A * 5/1997 Misawa et al. ..... 237/2 B
5,772,113 A * 6/1998 Gerstmann et al. ..... 237/8 R (Continued)

FOREIGN PATENT DOCUMENTS

JP 2000-039221 2/2000

(Continued)

OTHER PUBLICATIONS

U.S. Appl. No. 11/286,354 to Chang et al., filed Nov. 25, 2005.

(Continued)

*Primary Examiner*—Mohammad M. Ali
(74) *Attorney, Agent, or Firm*—Greenblum & Bernstein, P.L.C.

(57) ABSTRACT

An air conditioning system comprises a first tank connected to an outlet side refrigerant line of an indoor unit, a second tank disposed to be lower than the first tank, middle tank installed between the first tank and the second tank, a heat source cycle for depressurizing and cooling the first refrigerant inside the first tank by circulating a second refrigerant and heating the first refrigerant of the second tank, a middle tank cooling unit for feed back connected to an inlet side refrigerant line of the second tank among refrigerant lines of the heat source cycle, a middle tank heating unit for feed back connected to a refrigerant line between the first tank and the second tank among refrigerant lines of the heat source cycle, and a controller for selectively circulating the second refrigerant of the heat source cycle to the middle tank cooling unit for feed back or the middle tank heating unit for feed back.

16 Claims, 4 Drawing Sheets

U.S. PATENT DOCUMENTS

| | | | | |
|---|---|---|---|---|
| 5,950,447 | A * | 9/1999 | Maeda et al. | 62/271 |
| 5,956,962 | A * | 9/1999 | Takenaka et al. | 62/211 |
| 6,463,757 | B1 * | 10/2002 | Dickson et al. | 62/503 |
| 6,536,221 | B2 * | 3/2003 | James | 62/238.6 |

FOREIGN PATENT DOCUMENTS

| | | | |
|---|---|---|---|
| JP | 2002-340448 | A * | 11/2002 |
| JP | 2004-177067 | | 6/2004 |
| WO | 01/90663 | | 11/2001 |

OTHER PUBLICATIONS

English Language Abstract of JP 2000-039221.
English Language Abstract of JP 2004-177067.

* cited by examiner

AIR CONDITIONING SYSTEM

BACKGROUND OF THE INVENTION

1. Field of the Invention

The present invention relates to a multi-air conditioning system, and more particularly, to an air conditioning system having an improved refrigerant circulation structure capable of smoothly feeding back a refrigerant that circulates in a refrigerant circulation system.

2. Description of the Background Art

FIG. 1 is a construction view showing an air conditioning system in accordance with the conventional art.

As shown, the conventional air conditioning system comprises an indoor unit 111 for introducing a first refrigerant, a first tank (suction tank) 121 connected to an outlet side refrigerant line 111*b* of the indoor unit 111 for sucking a first refrigerant, a second tank (discharge tank) 141 disposed to be lower than the suction tank 121 and connected to an inlet side refrigerant line 111*a* of the indoor unit 111 for discharging a first refrigerant to the indoor unit 111, a middle tank 131 installed between the suction tank 121 and the discharge tank 141 for feeding back the first refrigerant stored in the suction tank 121 to the discharge tank 141, and a heat source cycle 150 for depressurizing and cooling the first refrigerant of the suction tank 121 by circulating a second refrigerant, and heating the first refrigerant of the discharge tank 141.

The discharge tank 141 is positioned to be lower than the middle tank 131, and the middle tank 131 is positioned to be lower than the suction tank 121. That is, the suction tank 121, the middle tank 131, and the discharge tank 141 are sequentially positioned.

A first connection line 125 for connecting a lower portion of the suction tank 121 to a lower portion of the middle tank 131 is installed between the suction tank 121 and the middle tank 131. A switching valve 137 is installed at the first connection line 125.

A first pressure equalizing line 123 for connecting a lower portion of the suction tank 121 to an upper portion of the middle tank 131 is installed between the suction tank 121 and the middle tank 131. The switching valve 137 is installed at the first pressure equalizing line 123.

A second connection line 135 for connecting a lower portion of the middle tank 131 to a lower portion of the discharge tank 141 is installed between the middle tank 131 and the discharge tank 141. The switching valve 137 is installed at the second connection line 135.

A second pressure equalizing line 133 for connecting an upper portion of the middle tank 131 to an upper portion of the discharge tank 141 is installed between the middle tank 131 and the discharge tank 141. The switching valve 137 is installed at the second pressure equalizing line 133.

The heat source cycle 150 comprises a compressor 151 for compressing a second refrigerant, a condenser 153 connected to an outlet side refrigerant line 151*a* of the compressor 151 and heat-exchanging with a first refrigerant inside the discharge tank 141, an evaporator 155 connected to an inlet side refrigerant line 151*b* of the compressor 151 and heat-exchanging with a first refrigerant inside the suction tank 121, and an outdoor expansion valve 157 installed at an outlet side refrigerant line 153*a* of the condenser 153.

In the conventional air conditioning system, in case of the heat source cycle 150, a second refrigerant provided from the compressor 151 passes through the condenser 153, the outdoor expansion valve 157, and the evaporator 155, and then is returned to the compressor 151, which is repeated.

In case of a heat driving system 110, a first refrigerant supplied from the discharge tank 141 passes through the indoor unit 111, and then is fed back to the suction tank 121, the middle tank 131, and the discharge tank 141, which is repeated.

The first refrigerant inside the discharge tank 141 is heat-exchanged by the condenser 153 thus to be introduced into the indoor unit 111. Then, the first refrigerant introduced into the indoor unit 111 is heat-exchanged via an indoor expansion valve 115 and an indoor heat exchanger 113, thereby heating or cooling an indoor room.

The first refrigerant having passed through the indoor unit 111 is introduced into the suction tank 121, and then is heat-exchanged by the evaporator 155 thus to be condensed. When the first refrigerant having an amount more than a certain degree is stored in the suction tank 121, a controller (not shown) controls each switching valve 137 of the first pressure equalizing line 123 and the first connection line 125. Accordingly, the first refrigerant stored in the suction tank 121 is fed back to the middle tank 131 by a height difference between the suction tank 121 and the middle tank 131 and by a gravitation.

Next, the controller controls each switching valve 137 of the second pressure equalizing line 133 and the second connection line 135 in the same manner as the aforementioned manner. Accordingly, the first refrigerant stored in the middle tank 131 is fed back to the discharge tank 141.

However, in the conventional air conditioning system, the first liquid refrigerant is fed back by a height difference among the suction tank, the middle tank, and the discharge tank and by gravitation. Accordingly, an entire volume of the air conditioning system is increased and an entire height of the air conditioning system is increased, thereby having a limitation in installing the air conditioning system and increasing a fabrication cost. Furthermore, the first refrigerant more than a certain amount has to be stored in the suction tank and the discharge tank.

BRIEF DESCRIPTION OF THE INVENTION

Therefore, an object of the present invention is to provide an air conditioning system capable of simplifying an entire structure thereof, facilitating to be installed, and reducing a fabrication cost.

Another object of the present invention is to provide an air conditioning system capable of minimizing an amount of a first refrigerant stored in a first tank and a second tank.

To achieve these and other advantages and in accordance with the purpose of the present invention, as embodied and broadly described herein, there is provided an air conditioning system, comprising: an indoor unit in which a first refrigerant flows; a first tank (a suction tank) connected to an outlet side refrigerant line of the indoor unit for sucking a first refrigerant; a second tank (a discharge tank) disposed to be lower than the suction tank and connected to an inlet side refrigerant line of the indoor unit for supplying the first refrigerant stored in the first tank to the indoor unit; a middle tank installed between the first tank and the second tank for connecting the first tank to the second tank; a heat source cycle for depressurizing and cooling the first refrigerant inside the first tank by circulating a second refrigerant, and heating the first refrigerant of the second tank; a middle tank cooling unit for feed back connected to an inlet side refrigerant line of the second tank among refrigerant lines of the heat source cycle for cooling the middle tank and maintaining a pressure inside the middle tank to be lower than a pressure inside the first tank; a middle tank heating unit for feed back connected to a refrigerant line between the first tank and the second tank among refrigerant lines of the heat source cycle for heating the middle tank and maintaining a pressure inside the middle tank to be higher than a pressure inside the second tank; and a controller for selectively circulating the second refrigerant of the heat source cycle to the middle tank cooling unit for feed back or the middle tank heating unit for feed back.

The heat source cycle comprises a cooling unit installed at the first tank, a heating unit connected to the cooling unit and installed at the second tank, a compressor for supplying a second refrigerant to the cooling unit and the heating unit, a first four-way valve installed at an outlet side refrigerant line of the compressor, an accumulator installed between the compressor and the first four-way valve for introducing a second gaseous refrigerant to the compressor, an outdoor heat exchanger for selectively radiating a second refrigerant discharged from the compressor, a second four-way valve installed at an inlet side refrigerant line of the second tank, and an expansion valve installed at a refrigerant line between the cooling unit and the heating unit.

The cooling unit is installed in the first tank, and the heating unit is installed in the second tank.

The middle tank cooling unit for feed back comprises a first refrigerant detour line connected to an inlet side refrigerant line of the second tank, a first heat exchanger disposed at the first refrigerant detour line and installed in the middle tank, and a plurality of switching valves installed at the first refrigerant detour line for selectively converting the second refrigerant provided from the compressor of the heat source cycle into the first refrigerant detour line.

The middle tank heating unit for feed back comprises a second refrigerant detour line connected to a refrigerant line between the first tank and the second tank, a second heat exchanger disposed at the second refrigerant detour line and installed in the middle tank, and a plurality of switching valves installed at the second refrigerant detour line for selectively converting the second refrigerant provided from the compressor of the heat source cycle into the second refrigerant detour line.

A first connection line for connecting a lower portion of the first tank to a lower portion of the middle tank is installed between the first tank and the middle tank. A switching valve for selectively opening and closing the first connection line is installed at the first connection line. A second connection line for connecting a lower portion of the middle tank to a lower portion of the second tank is installed between the middle tank and the second tank. A switching valve for selectively opening and closing the second connection line is installed at the second connection line.

A first refrigerant level sensor for detecting a level of a first refrigerant is installed in the first tank, and a second refrigerant level sensor and a third refrigerant level sensor are installed in the middle tank.

One side of a cooling line is connected to a lower portion of the second tank and another side of the cooling line is connected to the indoor unit, thereby introducing a first liquid refrigerant to the indoor unit. A switching valve for selectively opening and closing the cooling line is installed at the cooling line. One side of a heating line is connected to an upper portion of the second tank and another side of the heating line is connected to the indoor unit, thereby introducing a first gaseous refrigerant to the indoor unit. A switching valve for selectively opening and closing the heating line is installed at the heating line.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, an air conditioning system according to a preferred embodiment of the present invention will be explained with reference to the attached drawings.

Figure 1:
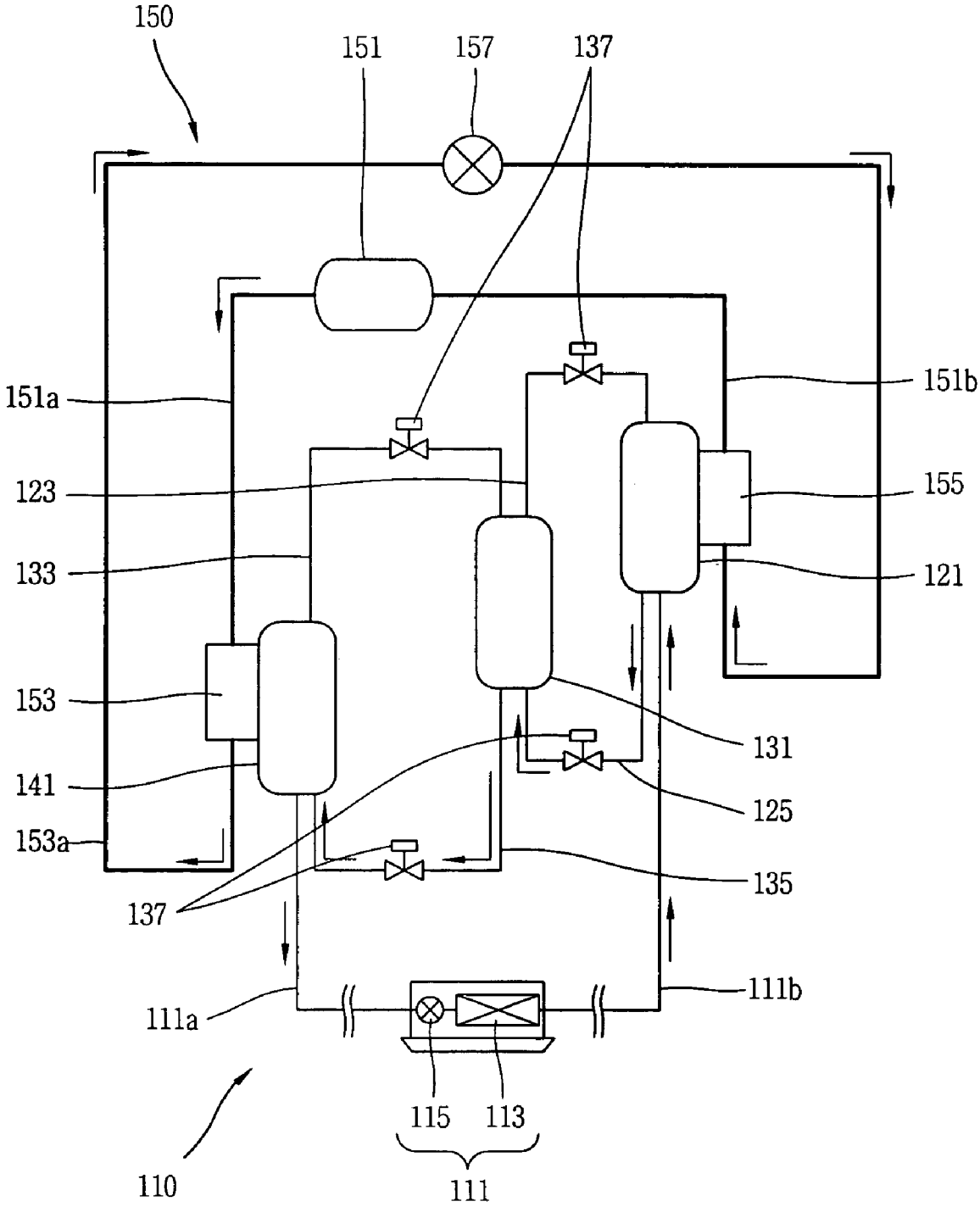
FIG. 1 CONVENTIONAL ART
FIG. 1 is a construction view showing an air conditioning system in accordance with the conventional art.
Figure 2:
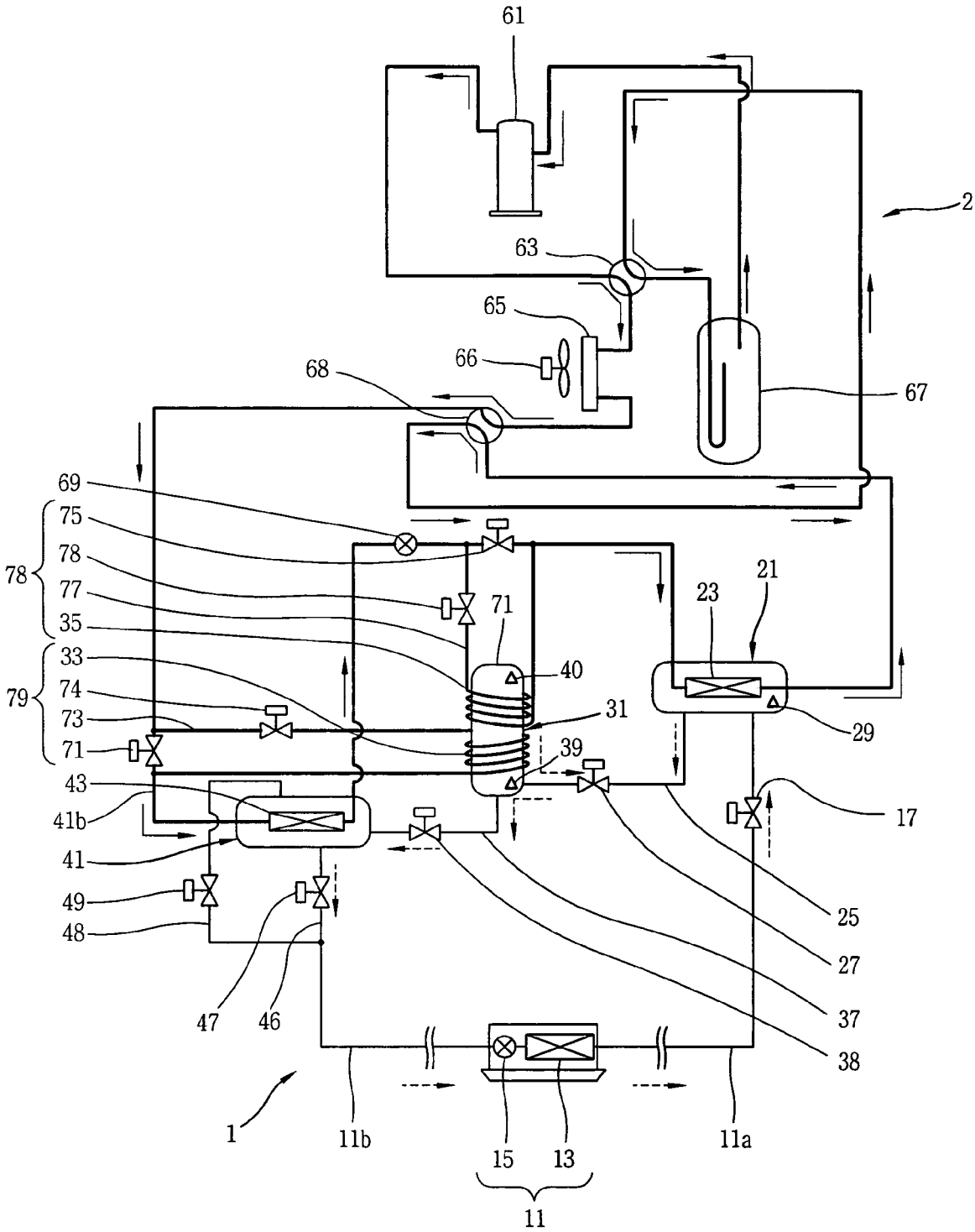
FIG. 2 is a construction view showing an air conditioning system according to a preferred embodiment of the present invention, which shows a refrigerant flow at the time of a cooling operation.
Figure 3:
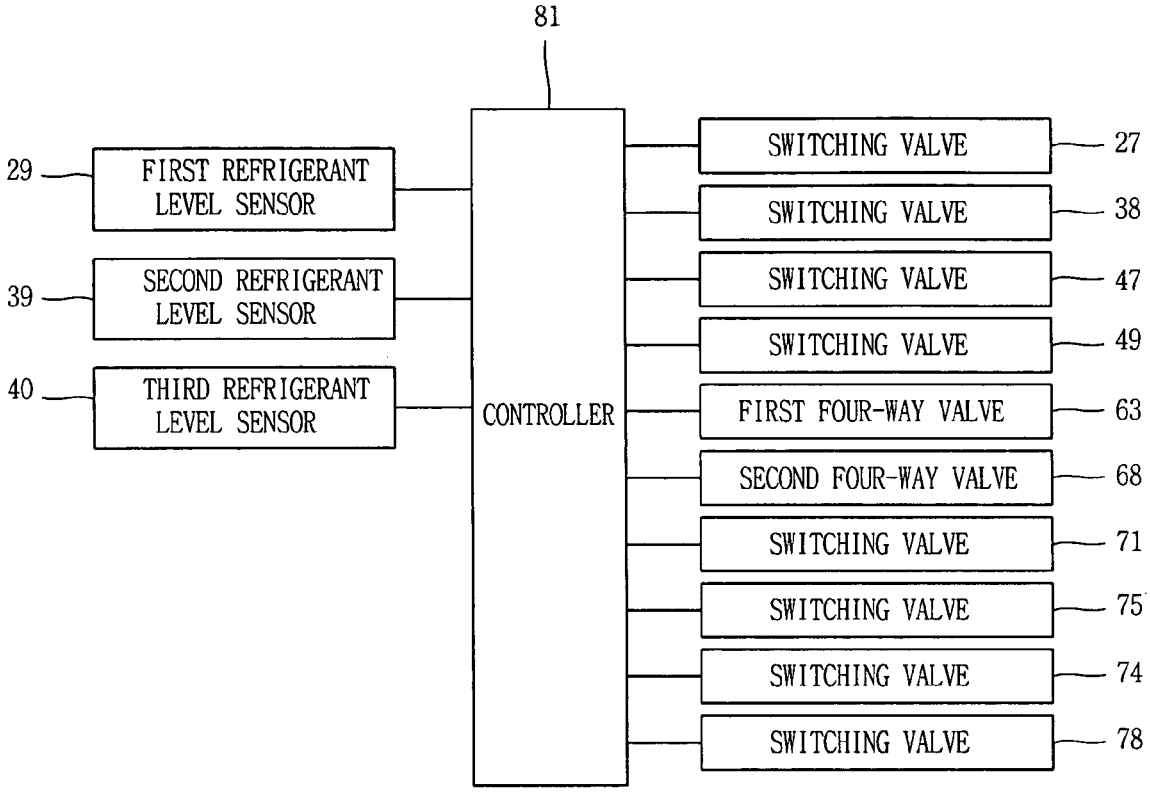
FIG. 3 is a block diagram showing a control process of the air conditioning system of FIG. 2.
Figure 4:
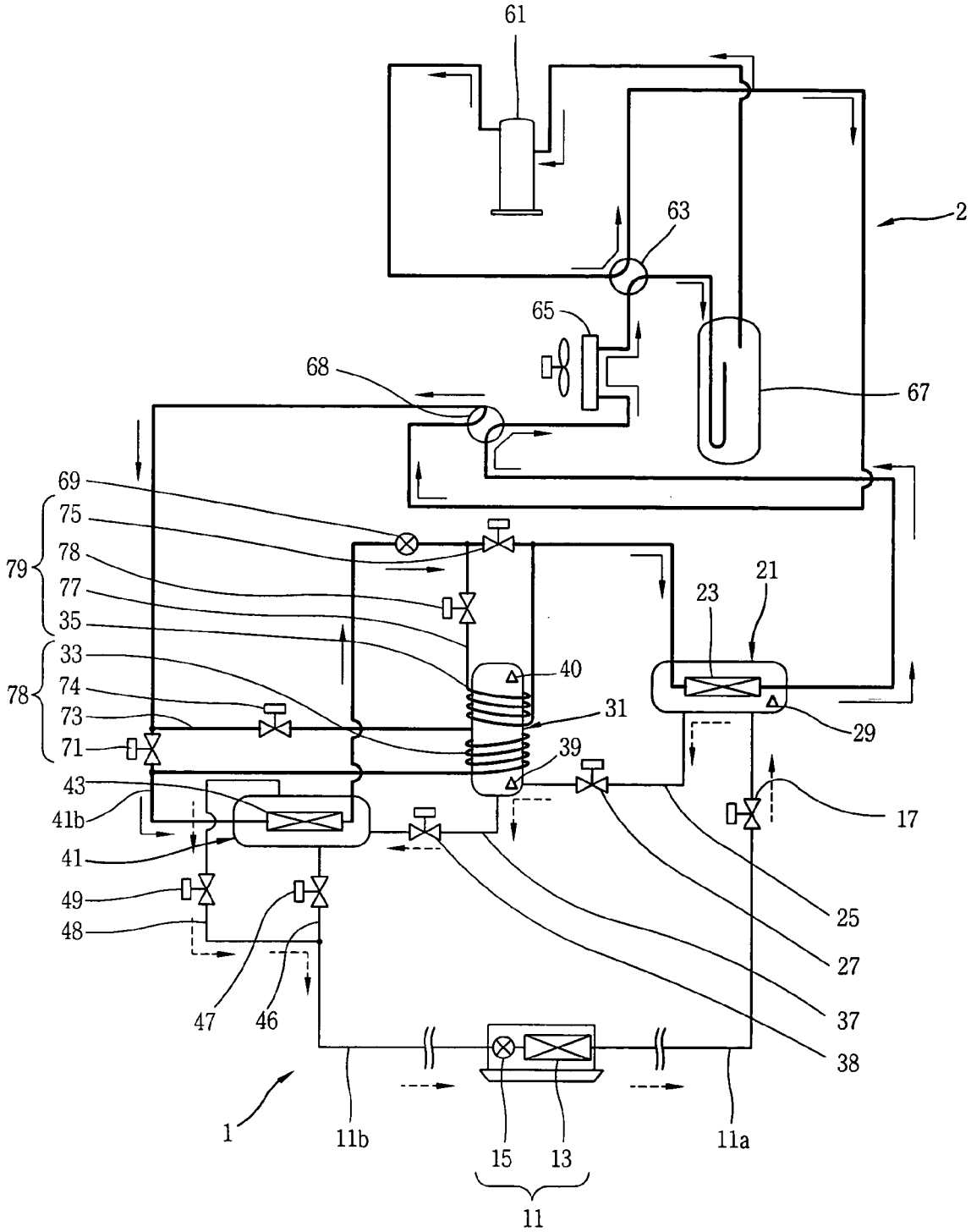
FIG. 4 is a construction view showing the air conditioning system according to a preferred embodiment of the present invention, which shows a refrigerant flow at the time of a heating operation.

FIG. 2 is a construction view showing an air conditioning system according to a preferred embodiment of the present invention, which shows a refrigerant flow at the time of a cooling operation, FIG. 3 is a block diagram showing a control process of the air conditioning system of FIG. 2, and FIG. 4 is a construction view showing the air conditioning system according to a preferred embodiment of the present invention, which shows a refrigerant flow at the time of a heating operation.

As shown, the air conditioning system according to the present invention comprises an indoor unit 11 in which a first refrigerant flows, a first tank (a suction tank) 21 connected to an outlet side refrigerant line 11*a* of the indoor unit 11 for sucking a first refrigerant, a second tank 41 positioned to be lower than the first tank 21 and connected to an inlet side refrigerant line 11*b* of the indoor unit 11 for supplying the first refrigerant to the indoor unit 11, a middle tank 31 installed between the first tank 21 and the second tank 41 for connecting the first tank 21 to the second tank 41, a heat source cycle 2 for depressurizing and cooling the first refrigerant inside the first tank 21 by circulating a second refrigerant, and heating the first refrigerant of the second tank 41, a middle tank cooling unit for feed back 79 connected to an inlet side refrigerant line 41*b* of the second tank 41 among refrigerant lines of the heat source cycle 2 for cooling the first refrigerant inside the middle tank 31 and maintaining a pressure inside the middle tank to be lower than a pressure inside the first tank, a middle tank heating unit for feed back 78 connected to a refrigerant line between the first tank 21 and the second tank 41 among refrigerant lines of the heat source cycle 2 for heating the first refrigerant inside the middle tank 31 and maintaining a pressure inside the middle tank to be higher than a pressure inside the second tank, and a controller 81 for selectively circulating the second refrigerant of the heat source cycle 2 to the middle tank cooling unit for feed back 79 or the middle tank heating unit for feed back 78.

The indoor unit 11 is installed at an indoor room in order to perform a cooling operation or a heating operation. An indoor heat exchanger 13 and an indoor expansion valve 15 are installed in the indoor unit 11.

On a heat driving system 1 including the indoor unit 11, the first tank 21, the middle tank 31, and the second tank 41, the first refrigerant flows. However, on the heat source cycle 2, the second refrigerant flows. The first refrigerant and the second refrigerant are converted into a liquid phase and a gaseous phase while flowing on the heat driving system 1 and the heat source cycle 2, respectively, thereby performing a heat exchange.

In the heat driving system 1, the first refrigerant discharged from the second tank 41 is introduced into the first tank 21 via the indoor unit 11. A first gaseous refrigerant of the first refrigerant introduced into the first tank 21 is cooled and depressurized by a cooling unit 54 of the heat source cycle 2 that will be later explained, and thus is condensed into a first liquid refrigerant. The first liquid refrigerant is fed back to the middle tank 31 by the controller 81. Then, a certain amount of the first liquid refrigerant fed back to the middle tank 31 is stored in the middle tank 31, and then is fed back to the second tank 41.

At the time of a cooling operation, the first liquid refrigerant fed back to the second tank 41 is introduced into the indoor unit 11 via a cooling line 46 with a low temperature and pressure state. On the contrary, at the time of a heating operation, the first gaseous refrigerant of the second tank 41 is introduced into the indoor unit 11 via a heating line 48 with a high temperature and pressure state. The above circulation process is repeatedly performed.

The middle tank cooling unit for feed back 79 comprises a first refrigerant detour line 73 connected to an inlet side refrigerant line 41*b* of the second tank 41, a first heat exchanger 33 disposed at the first refrigerant detour line 73 and installed in the middle tank 31, and a plurality of switching valves 71 and 74 installed at the first refrigerant detour line 73 for selectively converting the second refrigerant provided from the compressor 61 of the heat source cycle 2 into the first refrigerant detour line 73.

The middle tank heating unit for feed back 78 comprises a second refrigerant detour line 77 connected to a refrigerant line between the first tank 21 and the second tank 41, a second heat exchanger 35 disposed at the second refrigerant detour line 77 and installed in the middle tank 31, and a plurality of switching valves 75 and 78 installed at the second refrigerant detour line 77 for selectively converting the second refrigerant provided from the compressor 61 of the heat source cycle 2 into the second refrigerant detour line 77.

A first connection line 25 for connecting a lower portion of the first tank 21 to a lower portion of the middle tank 31 is installed between the first tank 21 and the middle tank 31. A switching valve 27 for selectively opening and closing the first connection line 25 is installed at the first connection line 25. A second connection line 37 for connecting a lower portion of the middle tank 31 to a lower portion of the second tank 41 is installed between the middle tank 31 and the second tank 41. A switching valve 38 for selectively opening and closing the second connection line 37 is installed at the second connection line 37.

A first refrigerant level sensor 29 for detecting a level of a first refrigerant is installed in the first tank 21, and a second refrigerant level sensor 39 and a third refrigerant level sensor 40 are installed in the middle tank 31.

One side of a cooling line 46 is connected to a lower portion of the second tank 41 and another side of the cooling line 46 is connected to the indoor unit 11, thereby introducing a first liquid refrigerant to the indoor unit 11. A switching valve 47 for selectively opening and closing the cooling line 46 is installed at the cooling line 46. One side of a heating line 48 is connected to an upper portion of the second tank 41 and another side of the heating line 48 is connected to the indoor unit 11, thereby introducing a first gaseous refrigerant to the indoor unit 11. A switching valve 49 for selectively opening and closing the heating line 48 is installed at the heating line 48.

The heat source cycle 2 comprises a cooling unit 23 installed at the first tank 21, a heating unit 43 connected to the cooling unit 23 and installed at the second tank 41, a compressor 61 for supplying a second refrigerant to the cooling unit 23 and the heating unit 43, a first four-way valve 63 installed at an outlet side refrigerant line 61*a* of the compressor 61, an accumulator 67 installed between the compressor 61 and the first four-way valve 63 for introducing a second gaseous refrigerant to the compressor 61, an outdoor heat exchanger 65 for selectively radiating a second refrigerant discharged from the compressor 61, a second four-way valve 68 installed at an inlet side refrigerant line 41*b* of the second tank 41, and an expansion valve 69 installed at a refrigerant line between the cooling unit 23 and the heating unit 43.

The cooling unit 23 is installed in the first tank 21, and the heating unit 43 is installed in the second tank 41. Besides the structure that the cooling unit 23 is installed in the first tank 21 and the heating unit 43 is installed in the second tank 41, any structure for cooling the first refrigerant of the first tank 21 and heating the first refrigerant of the second tank 41 is possible. An unexplained reference numeral 66 denotes a fan.

An operation of the air conditioning system according to the preferred embodiment of the present invention will be explained.

As shown in FIG. 2, the second refrigerant that circulates on the heat source cycle 2 is compressed by the compressor 61 at the time of a cooling operation. Then, the refrigerant passes through the first four-way valve 63, the outdoor heat exchanger 65, the second four-way valve 68, the heating unit 43, the outdoor expansion valve 69, the cooling unit 23, the second four-way valve 68, the first four-way valve 63, and the accumulator 67, and then is introduced into the compressor 61. The above circulation process is repeatedly performed.

The controller 81 closes the heating line switching valve 49, but opens the cooling line switching valve 47. Accordingly, the first liquid refrigerant stored in the second tank 41 is introduced into the indoor unit 11 through the cooling line 46 and the inlet side refrigerant line 11*b* of the indoor unit 11. The first liquid refrigerant introduced into the indoor unit 11 passes through the indoor expansion valve 15 and the indoor heat exchanger 13 thus to be expanded and heat-exchanged. Then, the first liquid refrigerant absorbs latent heat, and thereby cools the indoor room.

A first gaseous refrigerant vaporized after passing through the indoor expansion valve 15 is introduced into the first tank 21 via the outlet side refrigerant line 11*a* of the indoor unit 11. Then, the first gaseous refrigerant is cooled by the cooling unit 23, depressurized, condensed into a first liquid refrigerant, and then is stored in the first tank 21.

The first liquid refrigerant stored in the first tank 21 is fed back to the middle tank 31 by the middle tank cooling unit for feed back 79, and then is fed back to the second tank 41 by the middle tank heating unit for feed back 78.

The first refrigerant fed back to the second tank 41 and then stored in the second tank is introduced into the indoor unit 11 via the cooling line 46 at the time of a cooling operation, or is introduced into the indoor unit 11 via the heating line 48 at the time of a heating operation. The above process is repeatedly performed.

Hereinafter, an operation for sequentially feeding back the first liquid refrigerant stored in the first tank 21 to the middle tank 31 and the second tank 41 will be explained in more detail.

In the air conditioning system of the present invention, the first refrigerant is fed back by a pressure difference between the first tank 21 ad the middle tank 31 and by a pressure difference between the middle tank 31 and the second tank 41. When the first refrigerant level sensor detects the first liquid refrigerant inside the first tank 21, the controller 81 controls the first four-way valve 63 and the second four-way valve 68 thereby to control a flow of the second refrigerant as shown in FIG. 2. Then, the controller 81 closes the switching valve 71 and opens the switching valve 74, so that the second refrigerant of a low temperature and pressure provided from the compressor 61 is introduced into the second tank 41 via the first refrigerant detour line 73 and the first heat exchanger 33. As the second refrigerant of a low temperature and pressure passes through the first refrigerant detour line 73 and the first heat exchanger 33, a temperature inside the middle tank 31 becomes lower than a temperature inside the first tank 21 and thus a pressure inside the middle tank 31 is lowered. The controller 81 opens the switching valve 27 to open the first connection line 25, so that the first liquid refrigerant stored in the first tank 21 is fed back into the middle tank 31. When a certain amount of the first liquid refrigerant is stored in the middle tank 31, the third refrigerant level sensor 40 detects the first liquid refrigerant. Then, the controller 81 closes the switching valve 27.

As shown in FIG. 4, the controller 81 controls the first four-way valve 63 and the second four-way valve 68 thereby to control a flow of the second refrigerant. Then, the controller 81 closes the switching valve 75 and opens the switching valve 78 so that the second refrigerant of a high temperature and pressure provided from the compressor 61 can be introduced into the cooling unit 23 via the heating unit 43, the second refrigerant detour line 77, and the second heat exchanger 35, sequentially.

As the second refrigerant of a high temperature and pressure passes through the second refrigerant detour line 77 and the second heat exchanger 35, a temperature inside the middle tank 31 becomes higher than a temperature inside the second tank 41 and thus a pressure inside the middle tank 31 is increased. The controller 81 opens the switching valve 38 to open the second connection line 37, so that the first liquid refrigerant stored in the middle tank 31 is fed back into the second tank 41. When a certain amount of the first liquid refrigerant is discharged from the middle tank 31, the second refrigerant level sensor 39 detects the first liquid refrigerant. Then, the controller 81 closes the switching valve 38.

At the time of a cooling operation, the first liquid refrigerant fed back to the second tank 41 and stored in the second tank 41 is introduced into the indoor unit 11 via the cooling line 46. Then, the first liquid refrigerant is expanded via the indoor expansion valve 15 and the indoor heat exchanger 13, thereby cooling an indoor room.

The first gaseous refrigerant is introduced into the first tank 21 via the outlet side refrigerant line 11*a* of the indoor unit 11, and then is cooled and depressurized by the cooling unit 23. The depressurized first gaseous refrigerant is converted into a first liquid refrigerant, and then is fed back to the second tank 41 by the aforementioned manner, which is repeatedly performed.

At the time of a heating operation, as shown in FIG. 4, the second refrigerant that circulates on the heat source cycle 2 is compressed by the compressor 61. Then, the refrigerant passes through the first four-way valve 63, the second four-way valve 68, the heating unit 43, the outdoor expansion valve 69, the cooling unit 23, the second four-way valve 68, the outdoor heat exchanger 65, the first four-way valve 63, and the accumulator 67, and then is introduced into the compressor 61. The above circulation process is repeatedly performed.

The controller 81 closes the cooling line switching valve 47, but opens the heating line switching valve 49. Accordingly, the first gaseous refrigerant stored in the second tank 41 is introduced into the indoor unit 11 through the heating line 48 and the inlet side refrigerant line 11*b* of the indoor unit 11. The first gaseous refrigerant introduced into the indoor unit 11 passes through the indoor expansion valve 15 and is heat-exchanged by the indoor heat exchanger 13, thereby heating the indoor room.

The first gaseous refrigerant having passed through the indoor heat exchanger 13 is introduced into the first tank 21 via the outlet side refrigerant line 11*a* of the indoor unit 11. Then, the first gaseous refrigerant is cooled by the cooling unit 23, depressurized, and condensed into a first liquid refrigerant. The condensed first liquid refrigerant is fed back to the second tank 41 by the aforementioned manner, which is repeatedly performed.

As aforementioned, the first liquid refrigerant stored in the first tank is effectively fed back to the second tank by using a pressure difference between the first tank and the middle tank and a pressure difference between the middle tank and the second tank by cooling or heating the second refrigerant inside the middle tank. Accordingly, the entire structure of the air conditioning system is simplified, the installation is facilitated, and the fabrication cost is decreased. Furthermore, the amount of the first refrigerant stored in the first tank and the second tank can be decreased more than in the conventional art.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An air conditioning system, comprising:

an indoor unit in which a first refrigerant flows;

a first tank connected to an outlet side refrigerant line of the indoor unit for sucking a first refrigerant;

a second tank disposed to be lower than the suction tank and connected to an inlet side refrigerant line of the indoor unit for supplying the first refrigerant stored in the first tank to the indoor unit;

a middle tank installed between the first tank and the second tank for connecting the first tank to the second tank;

a heat source cycle for depressurizing and cooling the first refrigerant inside the first tank by circulating a second refrigerant, and heating the first refrigerant of the second tank;

a middle tank cooling unit for feed back connected to an inlet side refrigerant line of the second tank among refrigerant lines of the heat source cycle for cooling the middle tank and maintaining a pressure inside the middle tank to be lower than a pressure inside the first tank;

a middle tank heating unit for feed back connected to a refrigerant line between the first tank and the second tank among refrigerant lines of the heat source cycle for heating the middle tank and maintaining a pressure inside the middle tank to be higher than a pressure inside the second tank; and a controller for selectively circulating the second refrigerant of the heat source cycle to the middle tank cooling unit for feed back or the middle tank heating unit for feed back.

2. The system of claim 1, wherein the heat source cycle comprises:

a cooling unit installed at the first tank;

a heating unit connected to the cooling unit and installed at the second tank;

a compressor for supplying a second refrigerant to the cooling unit and the heating unit;

a first four-way valve installed at an outlet side refrigerant line of the compressor;

an accumulator installed between the compressor and the first four-way valve for introducing a second gaseous refrigerant to the compressor;

an outdoor heat exchanger for selectively radiating a second refrigerant discharged from the compressor;

a second four-way valve installed at an inlet side refrigerant line of the second tank; and an expansion valve installed at a refrigerant line between the cooling unit and the heating unit.

3. The system of claim 2, wherein the cooling unit is installed in the first tank, and the heating unit is installed in the second tank.

4. The system of claim 1, wherein the middle tank cooling unit for feed back comprises:

a first refrigerant detour line connected to an inlet side refrigerant line of the second tank;

a first heat exchanger disposed at the first refrigerant detour line and installed in the middle tank; and a plurality of switching valves installed at the first refrigerant detour line for selectively converting the second refrigerant provided from the compressor of the heat source cycle into the first refrigerant detour line.

5. The system of claim 1, wherein the middle tank heating unit for feed back comprises:

a second refrigerant detour line connected to a refrigerant line between the first tank and the second tank;

a second heat exchanger disposed at the second refrigerant detour line and installed in the middle tank; and a plurality of switching valves installed at the second refrigerant detour line for selectively converting the second refrigerant provided from the compressor of the heat source cycle into the second refrigerant detour line.

6. The system of claim 1, wherein a first connection line for connecting a lower portion of the first tank to a lower portion of the middle tank is installed between the first tank and the middle tank, a switching valve for selectively opening and closing the first connection line is installed at the first connection line, a second connection line for connecting a lower portion of the middle tank to a lower portion of the second tank is installed between the middle tank and the second tank, and a switching valve for selectively opening and closing the second connection line is installed at the second connection line.

7. The system of claim 1, wherein a first refrigerant level sensor for detecting a level of a first refrigerant is installed in the first tank, and a second refrigerant level sensor and a third refrigerant level sensor are respectively installed at an upper portion and a lower portion of the middle tank.

8. The system of claim 1, wherein one side of a cooling line is connected to a lower portion of the second tank and another side of the cooling line is connected to the indoor unit so that a first liquid refrigerant can be introduced into the indoor unit, a switching valve for selectively opening and closing the cooling line is installed at the cooling line, one side of a heating line is connected to an upper portion of the second tank and another side of the heating line is connected to the indoor unit so that a first gaseous refrigerant can be introduced into the indoor unit, and a switching valve for selectively opening and closing the heating line is installed at the heating line.

9. An air conditioning system, comprising:

a first tank connected to an outlet side refrigerant line of an indoor unit for sucking a first refrigerant;

a second tank disposed to be lower than the suction tank and connected to an inlet side refrigerant line of the indoor unit for supplying the first refrigerant stored in the first tank to the indoor unit;

a middle tank cooling unit for feed back connected to an inlet side refrigerant line of the second tank among refrigerant lines of the heat source cycle for cooling the middle tank so as to have a temperature lower than a temperature of the first refrigerant of the first tank; and a middle tank heating unit for feed back connected to a refrigerant line between the first tank and the second tank among refrigerant lines of the heat source cycle for heating the first refrigerant of the middle tank so as to have a temperature higher than a temperature of the first refrigerant of the second tank.

10. The system of claim 9, wherein the heat source cycle comprises:

a cooling unit installed at the first tank;

a heating unit connected to the cooling unit and installed at the second tank;

a compressor for supplying a second refrigerant to the cooling unit and the heating unit;

a first four-way valve installed at an outlet side refrigerant line of the compressor;

an accumulator installed between the compressor and the first four-way valve for introducing a second gaseous refrigerant to the compressor;

an outdoor heat exchanger for selectively radiating a second refrigerant discharged from the compressor;

a second four-way valve installed at an inlet side refrigerant line of the second tank; and an expansion valve installed at a refrigerant line between the cooling unit and the heating unit.

11. The system of claim 10, wherein the cooling unit is installed in the first tank, and the heating unit is installed in the second tank.

12. The system of claim 9, wherein the middle tank cooling unit for feed back comprises:

a first refrigerant detour line connected to an inlet side refrigerant line of the second tank;

a first heat exchanger disposed at the first refrigerant detour line and installed in the middle tank; and a plurality of switching valves installed at the first refrigerant detour line for selectively converting the second refrigerant provided from the compressor of the heat source cycle into the first refrigerant detour line.

13. The system of claim 9, wherein the middle tank heating unit for feed back comprises:

a second refrigerant detour line connected to a refrigerant line between the first tank and the second tank;

a second heat exchanger disposed at the second refrigerant detour line and installed in the middle tank; and a plurality of switching valves installed at the second refrigerant detour line for selectively converting the second refrigerant provided from the compressor of the heat source cycle into the second refrigerant detour line.

14. The system of claim 9, wherein a first connection line for connecting a lower portion of the first tank to a lower portion of the middle tank is installed between the first tank and the middle tank, a switching valve for selectively opening and closing the first connection line is installed at the first connection line, a second connection line for connecting a lower portion of the middle tank to a lower portion of the second tank is installed between the middle tank and the second tank, and a switching valve for selectively opening and closing the second connection line is installed at the second connection line.

15. The system of claim 9, wherein a first refrigerant level sensor for detecting a level of a first refrigerant is installed at an inner lower side of the first tank, and a second refrigerant level sensor for detecting a level of a second refrigerant is installed at an inner upper side of the middle tank.

16. The system of claim 9, wherein one side of a cooling line is connected to a lower portion of the second tank and another side of the cooling line is connected to the indoor unit so that a first liquid refrigerant can be introduced into the indoor unit, a switching valve for selectively opening and closing the cooling line is installed at the cooling line, one side of a heating line is connected to an upper portion of the second tank and another side of the heating line is connected to the indoor unit so that a first gaseous refrigerant can be introduced into the indoor unit, and a switching valve for selectively opening and closing the heating line is installed at the heating line.

* * * * *